US007779886B2

(12) United States Patent
Ganzi

(10) Patent No.: US 7,779,886 B2
(45) Date of Patent: Aug. 24, 2010

(54) DUAL FUNCTION MECHANISM FOR A VENETIAN BLIND

(75) Inventor: Yacov Ganzi, Kfar Neter (IL)

(73) Assignee: Holis Metal Industries Ltd., Afula Ilit (IL)

( * ) Notice: Subject to any disclaimer, the term of this patent is extended or adjusted under 35 U.S.C. 154(b) by 258 days.

(21) Appl. No.: 11/896,837

(22) Filed: Sep. 6, 2007

(65) Prior Publication Data

US 2008/0066876 A1 Mar. 20, 2008

(30) Foreign Application Priority Data

Sep. 19, 2006 (IL) ..... 178192

(51) Int. Cl.
*E06B 9/30* (2006.01)

(52) U.S. Cl. ..... 160/168.1 R; 160/173 R; 160/178.2

(58) Field of Classification Search ..... 160/168.1 R, 160/173 R, 178.2, 178.1 R, 176.1 R, 177; 254/385

See application file for complete search history.

(56) References Cited

U.S. PATENT DOCUMENTS 5,465,775 A * 11/1995 Biba et al. ..... 160/168.1 R
5,472,035 A * 12/1995 Biba et al. ..... 160/168.1 R
5,501,262 A * 3/1996 Inaba et al. ..... 160/178.2
5,513,687 A * 5/1996 Tuzmen et al. ..... 160/168.1 R
5,553,653 A * 9/1996 Rozon ..... 160/173 R
5,671,793 A 9/1997 Lee
5,709,258 A * 1/1998 Coccoluto ..... 160/168.1 R
5,722,478 A * 3/1998 Claypool et al. ..... 160/173 R
6,189,595 B1 * 2/2001 Lee ..... 160/168.1 R
6,196,293 B1 * 3/2001 Lee ..... 160/168.1 V
6,516,860 B1 * 2/2003 Weaver et al. ..... 160/168.1 R
2008/0066876 A1 * 3/2008 Ganzi ..... 160/168.1 R

FOREIGN PATENT DOCUMENTS

EP 1 557 524 A2 7/2005

* cited by examiner

*Primary Examiner*—Blair M. Johnson
(74) *Attorney, Agent, or Firm*—The Nath Law Group; Susanne M. Hopkins; Jiaxiao Zhang

(57) ABSTRACT

A Venetian blind and a control mechanism therefore, comprising a plurality of slats suspended from a headrail by lift cords, the control mechanism comprising a hollow rod articulated to the headrail and accommodating the lift cords extending to a elevation assembly manipulable by an actuator slidingly received over the rod. Upward displacing of the actuator entails lowering of the slats and downwards displacing of the actuator entails raising of the slats, and a friction mechanism for arresting the slats at any respective elevation.

17 Claims, 9 Drawing Sheets

DUAL FUNCTION MECHANISM FOR A VENETIAN BLIND

FIELD OF THE INVENTION

This invention relates to control mechanisms for blinds, more particularly to an controller mechanism used with Venetian type blinds (louvered blinds), adapted to raise/lower and tilt the slats of such a blind.

BACKGROUND OF THE INVENTION

Venetian blinds are very commonly used for shielding window and door openings to block the passage of light and to provide privacy. Venetian type blinds comprise a plurality of horizontal slats (also referred to as louvers or vanes), parallely extending, that can be tilted about a parallel, horizontal axis to open and to close the window blind.

Typically, tilt of such slats is controlled by rotation of a rod attached to a gear mechanism or by pulling on a chain engaged with a gear mechanism. Raising and lowering of the slats is facilitated by pulling a cord attached to a mechanism that engages the cord to lock the location of the slats at a desired elevation.

Conventional blinds incorporate a looped cord having two cord lengths. The cord lengths are attached to a mechanism inside the blind that moves the slats, and either cord length can be pulled to selectively open or close the blind vanes. Such looped cords hang free from one side of the blind, and the necessary length of the looped cord depends on the width of the opening. Blinds for large openings require a looped cord extending to the floor, which creates a potential safety hazard for small children. Also, the cord has the tendency to tangle with adjacent objects and at times also with the rod.

Various mechanisms have been proposed for addressing this issue. For example, electrically powered mechanisms are known for controlling the tilt and elevation of the slats. These mechanisms however require the provision of an adjacent electric socket and further, such mechanisms are relatively complex and expensive. According to an other concept mechanical means are provided for control of the slats. For example, U.S. Pat. No. 5,671,793 discloses a controller for opening and closing Venetian blind vanes over a door or window opening, the mechanism comprising a pull cord that is engaged with a pulley, which is moved with a loop cord selectively engaged with a cord lock attached to a handle. A rotatable switch in the cord lock is rotated, the cord lock grasps the loop cord, and the handle is moved downwardly to pull to loop cord. Such movement operates the pulley and pull cord to raise the blind vanes. When the cord lock is disengaged, the weight of the blind returns the components to the original position. A rotatable tilt switch or combination of rotatable tilt switches are attached to a tilt rod for selectively rotating the blind vanes. All cords are completely enclosed so that looped ends of the cords are not accessible to persons adjacent the window blind.

Another arrangement is disclosed in EP1557524A2 relating to lift and tilt mechanisms for a Venetian blind comprising a plurality of parallel elongated slats and pairs of tilt and lift cords, where the lift and tilt mechanisms comprise a tubular member mounted for rotation with and axial displacement over a drive shaft and guide means for maintaining the lift cords in their proper axial position and for directing the lift cords to the outer circumferential surface of said tubular member, whereby the lift cords upon rotation of said tubular member will become helically wound on or off the circumferential surface of the tubular member resulting in said slats being raised or lowered as the tubular member rotates.

SUMMARY OF THE INVENTION

According to the present invention, there is provided a control mechanism for blinds, in particular Venetian-type blinds, said mechanism adapted for controlling elevation of the slats of the blinds, i.e. their raising and lowering.

The invention calls for a control mechanism for a Venetian blind comprising a plurality of slats suspended from a headrail by lift cords, said control mechanism comprising a hollow rod articulated to the headrail and accommodating said lift cords extending to a elevation assembly manipulable by an actuator slidingly received over the rod; wherein upward displacing of the actuator entails lowering of the slats and downwards displacing of the actuator entails raising of the slats, and a friction mechanism for arresting the slats at any respective elevation.

According to the present invention there is provided a control mechanism for a Venetian blind comprising a plurality of slats suspended from a headrail by lift cords collectable within said headrail by spools, said mechanism comprising a hollow rod articulated to the headrail and accommodating said lift cords extending to a lead bar coaxially displaceable within the rod, an actuator slidingly received over the rod and engaged with the lead bar; wherein upward displacing of the actuator entails lowering of the slats and downwards displacing of the actuator entails raising of the slats, and a friction mechanism for arresting the lead bar within the rod at any respective location.

According to a particular embodiment of the invention, the friction mechanism comprises a friction member axially displaceable over a tapering portion of the lead bar, between an unlocked position wherein the friction member is shrunken and is free to slide within the rod, and a locked position wherein the friction member is expanded and frictionally arrested within the rod.

According to this embodiment the friction member is displaceable into the unlocked position by a sleeve coaxially extending between the lead bar and the rod, said sleeve being articulated to the actuator and is displaceable between a first position where the friction member is retained at its locked position, and a second position wherein the friction member is displaced into its unlocked position.

The sleeve is normally biased into the first position. This may be achieved by a biasing member having one end bearing against the sleeve and a second end bearing against an end portion of the lead bar. Further biasing of the sleeve is achieved by a force generated by the load of the slats pulling the lead bar so as to displace with respect to the sleeve.

The design is such that a friction member extends between a first sleeve segment and a second sleeve segment. Optionally the second sleeve segment extends between the first sleeve segment and a third sleeve segment, said sleeve segments being compacted by a biasing member.

The arrangement is such that friction fit between the sleeve and an inside surface of the rod is tighter than fit between the sleeve and the lead bar, whereby the mechanism does not spontaneously displace under weight of the slats.

The friction member is an O-ring, though other forms are possible too. However, the friction member is axially displaceable with respect to a tapering portion of the lead bar, wherein when the friction member is displaced towards a narrow end of the tapering portion it obtains its nominal diameter abs substantially does not radially project from the diameter of the sleeves such that there is substantially no friction with the inner surface of the rod. However, when the friction member is displaced towards larger end of the tapering portion its is forced to obtain a diameter larger then its nominal diameter and it radially projects from the sleeves, so as to generate friction force, to thereby arrest the sleeves within the rod.

Typically, the actuator is formed with an ergonomically shaped body so as to be easily gripped by an individual for manually displacing it up and down along the rod.

It is common practice with Venetian blinds that the slats are supported by string ladders.

Furthermore, according to a design of the invention, the actuator is articulated to the lead bar and to the sleeve by a shift pin having one end received within the actuator and a second end thereof received within a cavity formed in the lead bar; said shift pin extending through an aperture formed in the sleeve.

The arrangement being such that displacing the actuator in a first direction entails corresponding displacement of the sleeve and lead bar in said first direction, however with advanced displacement of the lead bar, and sliding displacing the actuator in a second direction entails corresponding displacement of the sleeve and lead bar in said second direction, however with advanced displacement of the lead bar.

Furthermore, while displacing the actuator in the first direction the shift pin is retains a substantially upright position, and while displacing the actuator in the second direction the shift pin pivots within the actuator and within the aperture formed in the sleeve.

Displacing the actuator along the rod while being articulated to the leading rod is facilitated by a longitudinal slot formed in the rod for slidingly accommodating the shift pin.

According to an embodiment of the invention, the rod is articulated at a top end thereof with a tilt mechanism received within the headrail, whereby revolving the rod about its longitudinal axis either clock-wise or counter clock-wise entails corresponding tilt of the blinds in one direction or the other.

According to another aspect of the present invention there is provided a Venetian blind comprising a plurality of slats suspended from a headrail by lift cords collectable within said headrail by spools, and a control mechanism comprising a hollow rod articulated to the headrail and accommodating said lift cords extending to a lead bar coaxially displaceable within the rod, an actuator slidingly received over the rod and engaged with the lead bar; wherein upward displacing of the actuator entails lowering of the slats and downwards displacing of the actuator entails raising of the slats, and a friction mechanism for arresting the lead bar within the rod at any respective location.

BRIEF DESCRIPTION OF THE DRAWINGS

In order to understand the invention and to see how it may be carried out in practice, an embodiment will now be described, by way of a non-limiting example only, with reference to the accompanying drawings, in which.

DETAILED DESCRIPTION OF EXEMPLARY EMBODIMENTS

Figure 1:
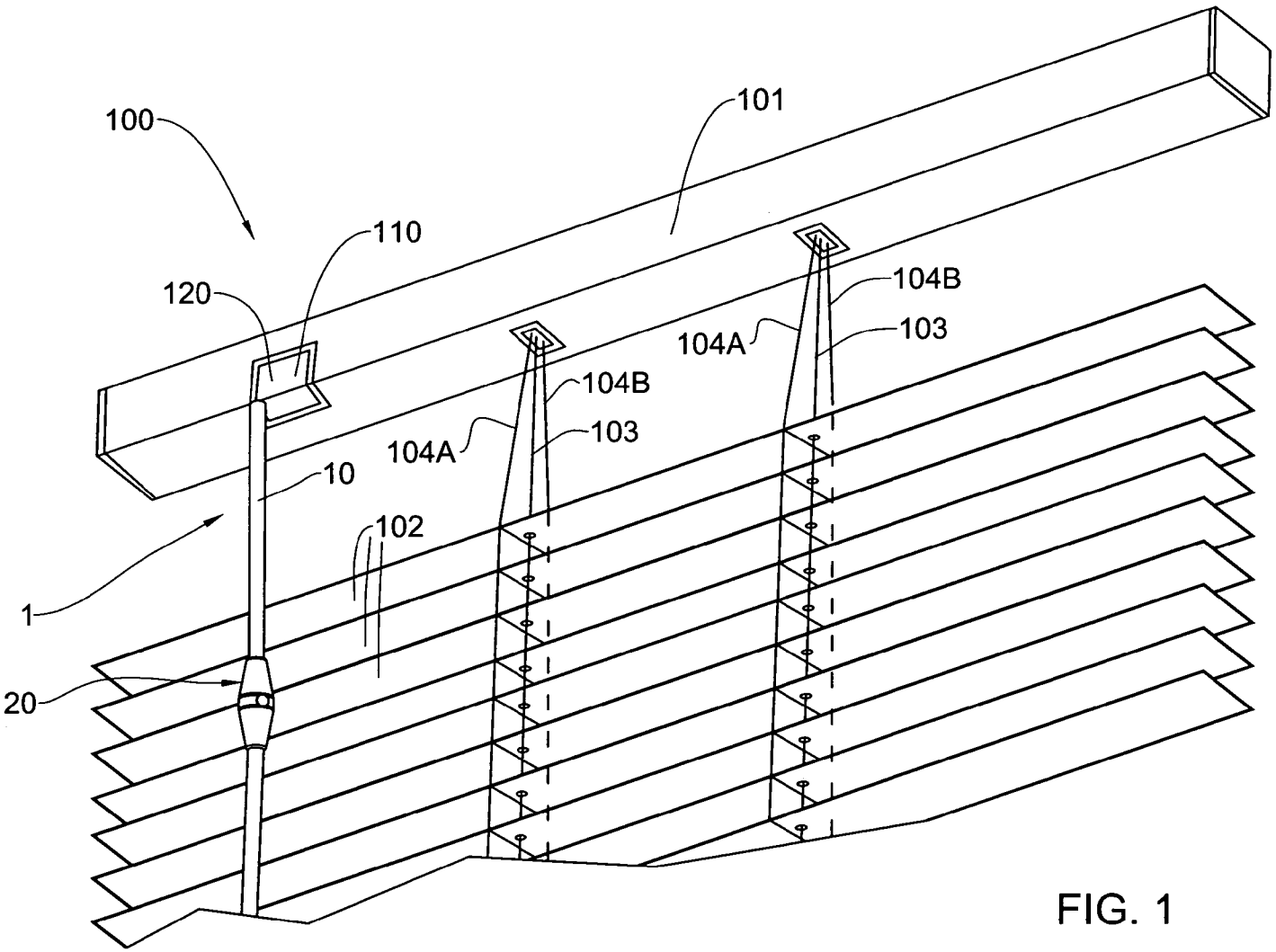
FIG. 1 is an isometric view of a Venetian blind assembly comprising a control mechanism according to the present invention.

FIG. 1 shows a Venetian blind generally designated 100 fitted with a control mechanism generally designated 1. The Venetian blinds assembly comprises a headrail 101 and a plurality of slats/blinds 102 extending from the headrail 101 by two or more main lift cord 103, adapted for raising and lowering the slats 102. The slack of said lift cords, depending on the elevation of the slats 102, is collectable by spools (not seen) received within the headrail 101, as known per se. There are further provided ladders comprising auxiliary cords 104A, 104B for supporting and tilting of the slats 102. The headrail 101 is fitted with a combined raising/lowering and tilting mechanism 110 (received and concealed within the headrail 101 and is thus schematically illustrated), adapted for raising/lowering and tilting the blinds respectively, as known per se.

Figure 2:
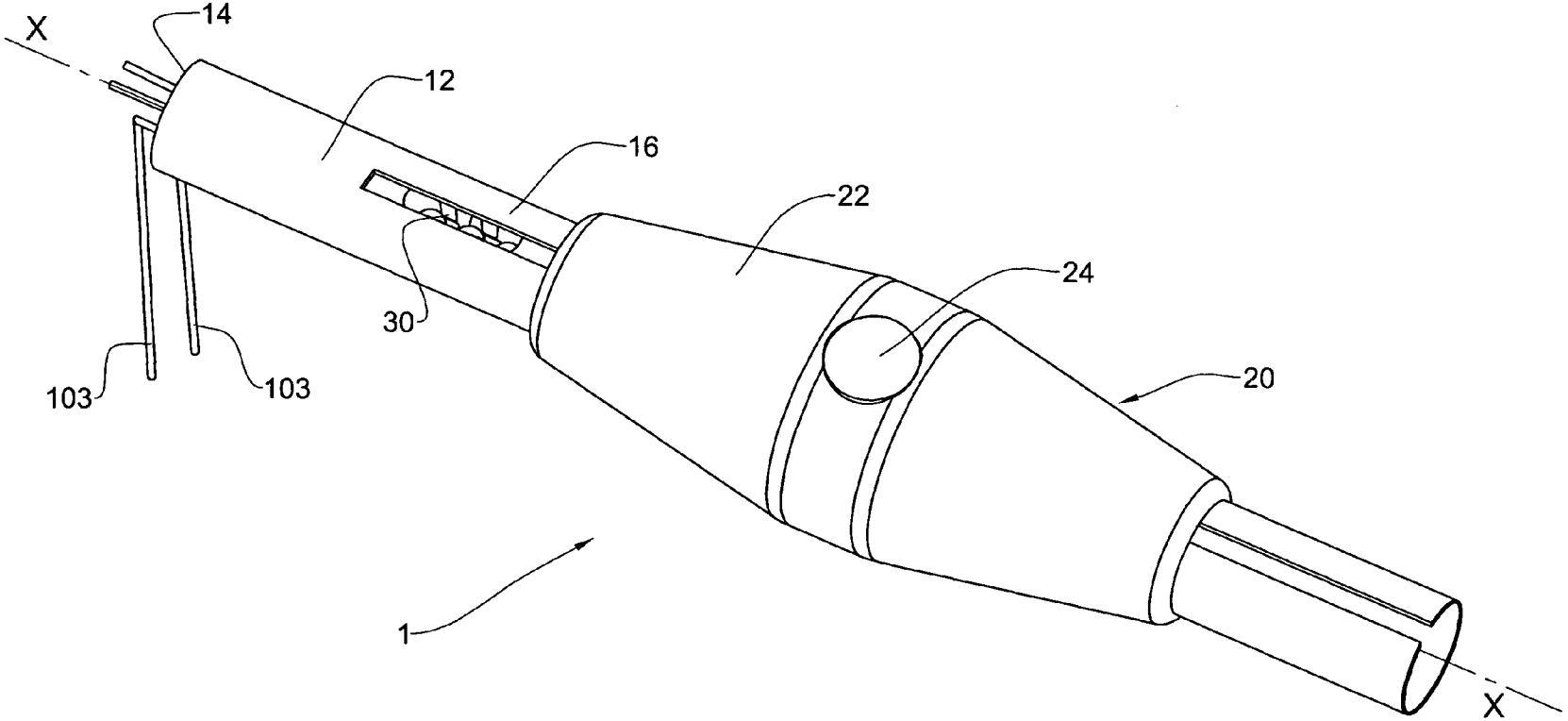
FIG. 2 is an enlarged isometric view of an actuator of the control mechanism of FIG. 1.

Referring now to FIG. 2, the control mechanism 1 comprises a rod (actuating wand) 10 in the form of main hollow rod articulated to the combined mechanism 110 of the blinds as will be explained in detail later. The rod 10 has a body 12 formed with an axial hollow 14 therein. A longitudinal slot 16 extends along the majority of the hollow rod 10. In fact, the length of the slot 16 defines the extent to which the raising/lowering mechanism can travel and respectively the raising/lowering extent of the slats 102, as will become apparent hereinafter. In the present example, the length of the slot is 50% the height of the blind, however, this length may be greater or shorter, by providing a length ratio manipulator.

An actuator 20, in the form of a grip handle, comprises a body 22 and a knob 24 and is slidingly mounted onto the rod 10. An actuating mechanism 30 is received within the hollow rod 10, and articulated to the actuator 20 and to the combined mechanism 110 as will be explained in detail herein below. Also received within the rod 10 are raising/lowering cords 103, to be further discussed hereinafter.

The arrangement is such that the rod 10 is free to rotate about its longitudinal axis X-X thus allowing tilting of the blinds 102 as with a conventional Venetian blind. The actuator 20 is free to slide up and down along the rod 10, for lowering or raising the blinds 102 respectively, as will be explained hereinafter.

With further reference also to FIGS. 3A-C, 4A and 4B, the actuating mechanism 30 is received within the hollow rod 10 and is articulated to a lift cord coupling unit 50 (FIG. 3A, 3C)using a ball link 40, acting as an axial coupler however not transferring rotary motion between the lead rod 31 and the cord 103, as will be appreciated later. The lift cord coupling unit 50 is connected, in turn, to the main lift cord 103 (FIG. 2). The actuating mechanism 30 comprises a lead bar 31 formed at a top distal end thereof with a connector portion 32, adapted for coupling to the ball chain 40. The lead bar 31 is further formed with a tapering portion 33 (best seen in FIG. 4B) extending between a portion of the of the lead bar 31 having a large diameter 'D', and a portion of the lead bar 31 having a smaller diameter 'd', with a rubber O-ring 34 mounted over said tapering portion 33 and positioned between a first sleeve 35A and a second sleeve 36, both coaxially received between the lead bar 31 and the hollow rod 10 in a fairly tight manner. A coiled spring 37 is mounted onto the lead bar 31, between the connector portion 32 and the second sleeve 36 thereby giving rise to a biasing force between the lead bar 31 and the second sleeve 36.

A shift pin 26 interconnects the actuator assembly 20 (FIGS. 3A and 3B), and the actuating mechanism 30, extending through the longitudinal slot 16 of the hollow rod 10 and an aperture 39 formed in the sleeve 35B. The pin 26 is engaged at one end thereof with the handle knob 24, and at its respective other end with a shaped cavity 38 formed within the lead bar 31 of the actuating mechanism 30.

Figure 3B:
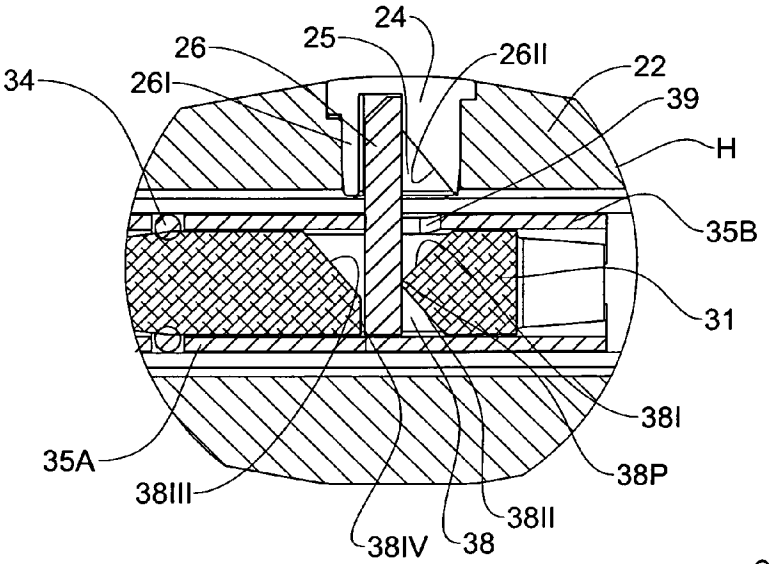
FIG. 3B is an enlargement of a detail 'H' of FIG. 3A.
Figure 5:
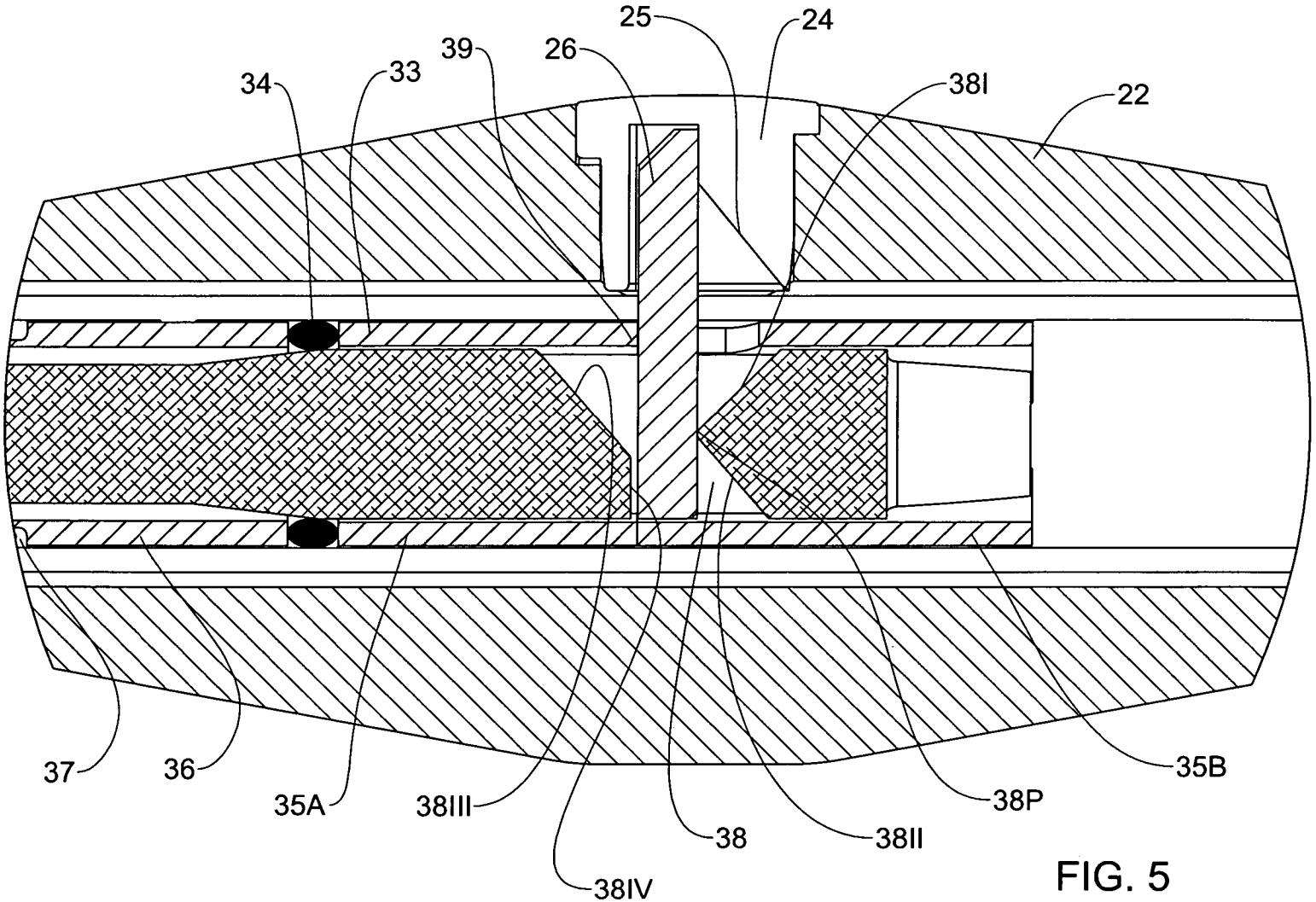
FIG. 5 is a cross section view of the control mechanism during raising of the slats.

As noted also in FIGS. 5 to 7, however best in FIG. 3B, the shaped cavity 38 is formed with a first inclined surface 38I, a second inclined surface 38II, with a pivot point 38P there between, a third inclined surface 38III and a substantially vertically extending surface 38IV. Knob 24 is formed with a receptacle 25 with a main, substantially vertical channel 26I and an inclined wall surface 26II.

The shift pin 26 is so positioned that it is able to perform an angular/pivotal displacement within the cavity 38 of the lead bar 31 and within the knob 24, as will be explained in detail later.

The arrangement is such that when the pin 26 is at its normal, standby position it extends substantially upright (as seen in FIGS. 3, 5, 6A and 7A) whereby the pin aligned within the opening 38 and receptacle 25, i.e. substantially parallel to the surfaces 26I and 38IV.

In operation, when the blinds assembly 100 is at rest (regardless of the position of the blinds, namely raised/lowered or tilted), the weight of the slats 102 applies tension via cords 103 on the lift cord coupling unit 50, and consequently on the lead bar 31. Since the fit between the sleeve portions 35A and 36 and the inside surface of the hollow rod 10 is tighter than that between the hollow rod 10 and the sleeves 35A and 36, the weight of the slats 102 causes the lead bar 31 to move upwards (i.e. in direction of arrow 107 in FIG. 3A), while the sleeves 35A and 36 are temporarily held in place by friction. During such displacement of the lead bar 31, the sleeve 36 partially arrests the friction ring 34, whereby progress of the lead bar 31 causes the ring 34 to extend now over a larger diameter of the tapering surface 33, adjacent a rear end thereof end, subsequently entailing an expansion in the diameter of the friction ring 34. Once the friction ring 34 is expanded, the friction between the friction ring 34 and the inner surface of the hollow rod 10 facilitates jamming of the actuating mechanism 30, arresting it further axial displacement upwards within the hollow rod 10 under the self weight of the slats 102, thus keeping the blinds at a fixed elevation position, namely "fixed mode".

During raising of the slats 102 as seen in FIG. 5, namely switching to a "raising mode", downward displacement (i.e. in a direction opposed to that of arrow 107) of the actuator 20 is required. This downward displacement of the actuator 20 entails a corresponding downward displacement of the lead bar 31, due to the engagement by the shift pin 26, extending substantially upright and linking between the actuator 22 and the lead rod 31. During such displacement the pin 26 does not pivot within the receptacle 25 and opening 38. Since the first sleeve 35A and the second sleeve 36 are tightly fit within the hollow rod 10, they stay temporarily in place, whereby downward displacement of only the lead bar 31, entails displacing the friction ring 34 (formerly trapped between the sleeves 35A and 36) to become positioned over the small diameter 'd' of the tapering portion 33. Consequentially, the coiled spring 37 becomes compressed between a shoulder of the connector portion 32 of lead rod 31 and an end face of the second sleeve 36. It is appreciated that when positioned on the small diameter 'd', the friction ring 34 shrinks, acquiring a smaller diameter, whereby the friction between the friction ring 34 and the hollow rod 10 is reduced, allowing the inner mechanism to freely slide down the rod 10.

Gripping the body 22 of the actuator 20 and sliding it downwards over the rod 10 entails corresponding downwards displacement of the lead rod 31 and the articulated coupling unit 50, thereby pulling on the lift cord 103, resulting in raising the slats 102. Here it is important to note that although the sleeves 35 and 36 are tightly fit into the hollow rod 10, the fit is such that they are still able to displace the length of the rod 10 along with the actuator 20 when raising and lowering the blinds, however as long as the O-ring 34 is at its shrunken position.

Figure 3A:
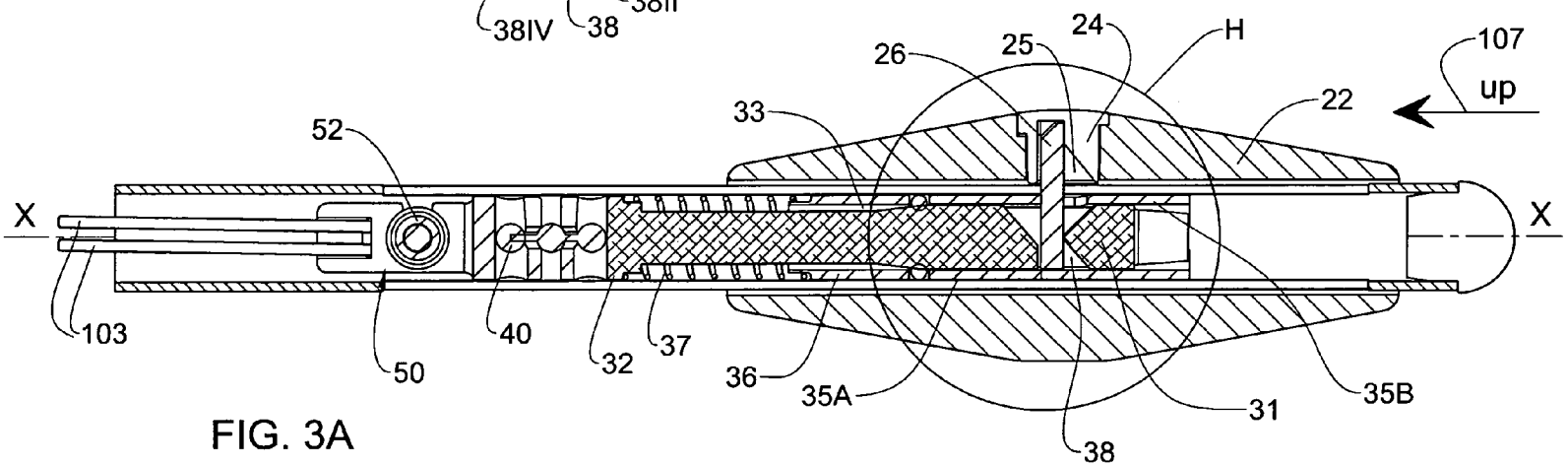
FIG. 3A is a longitudinal cross section view of the actuator and rod of the control mechanism according to the invention.
Figure 3C:
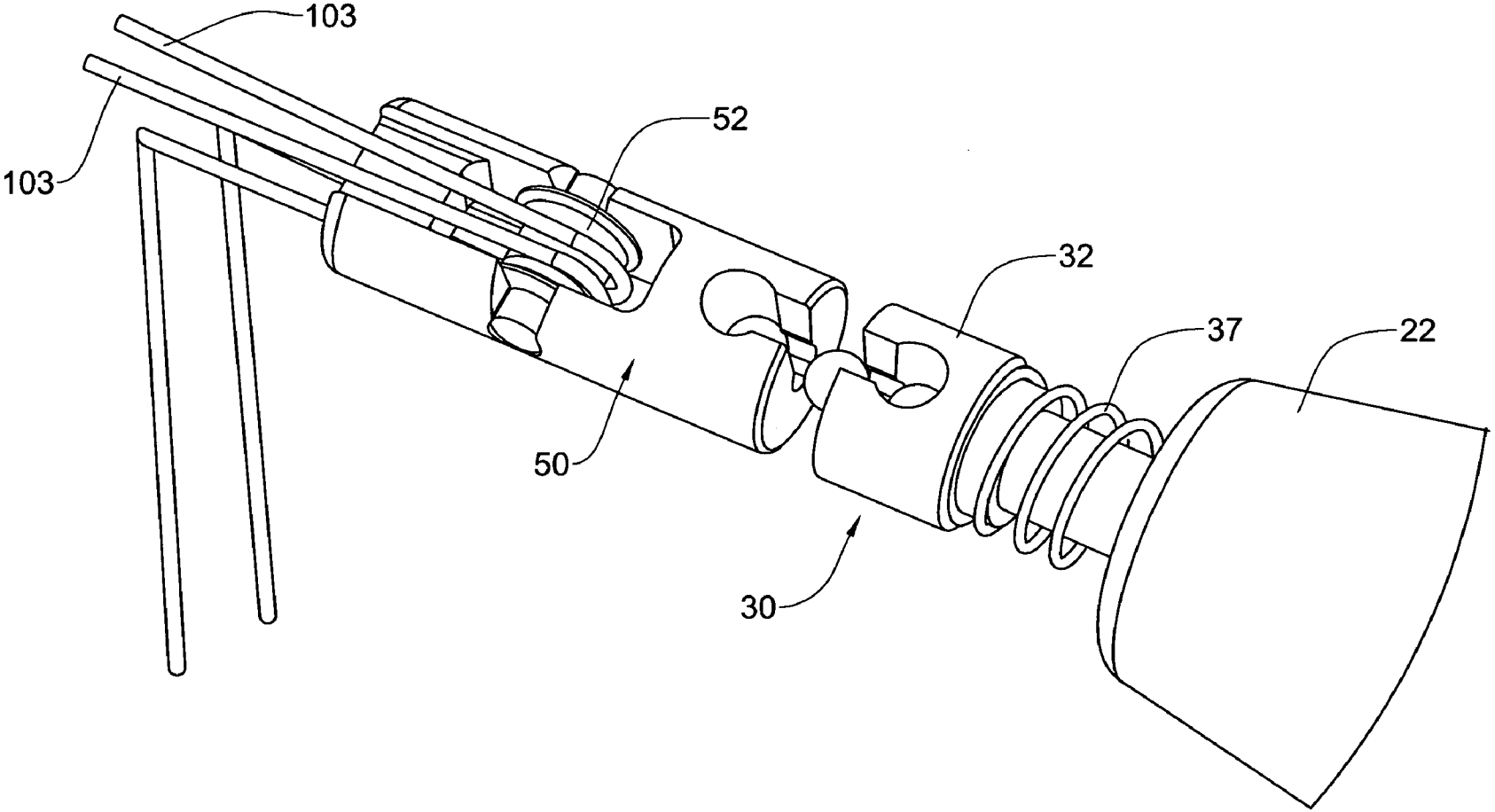
FIG. 3C is an enlarged isometric view of the portion marked III in FIG. 3A.
Figure 4A:
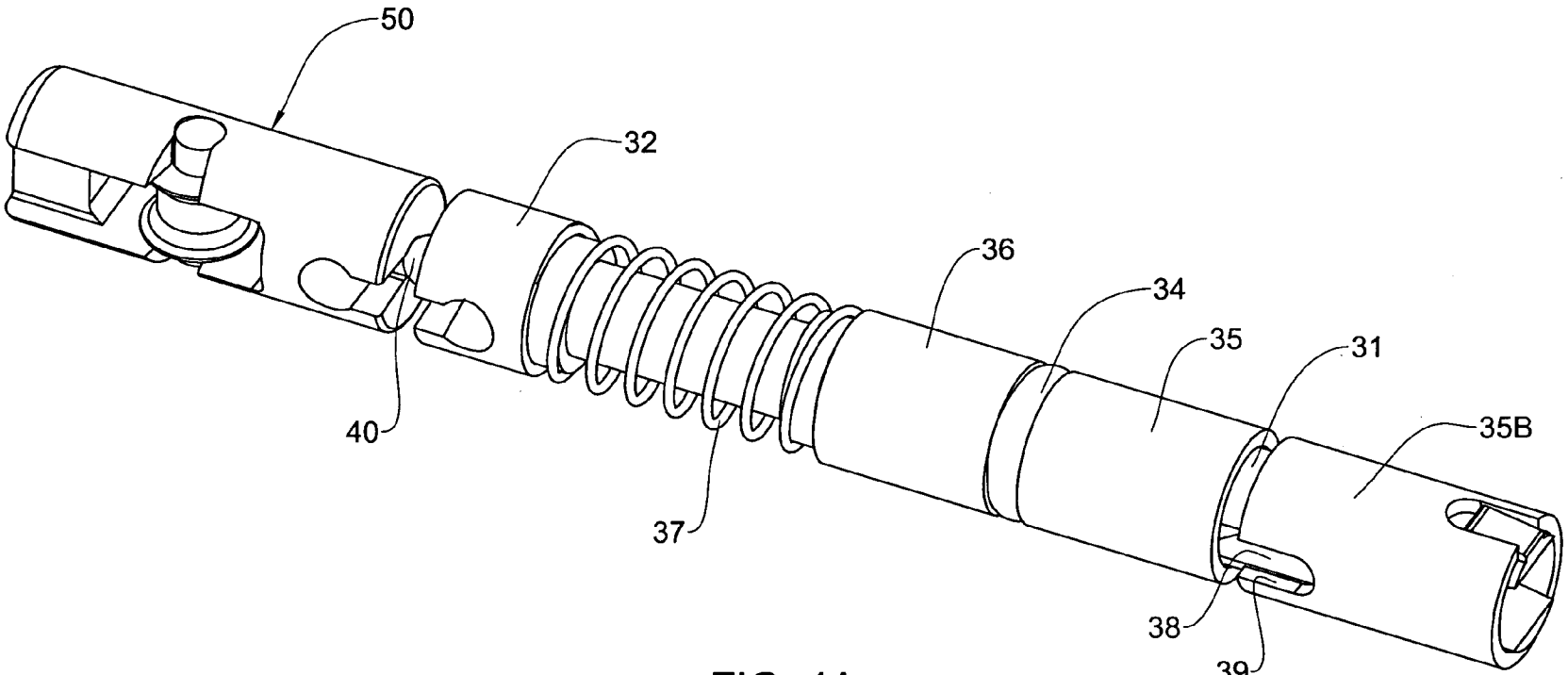
FIG. 4A is an isometric view of the control mechanism of FIG. 2 with the actuator and hollow rod removed for visualization.
Figure 4B:
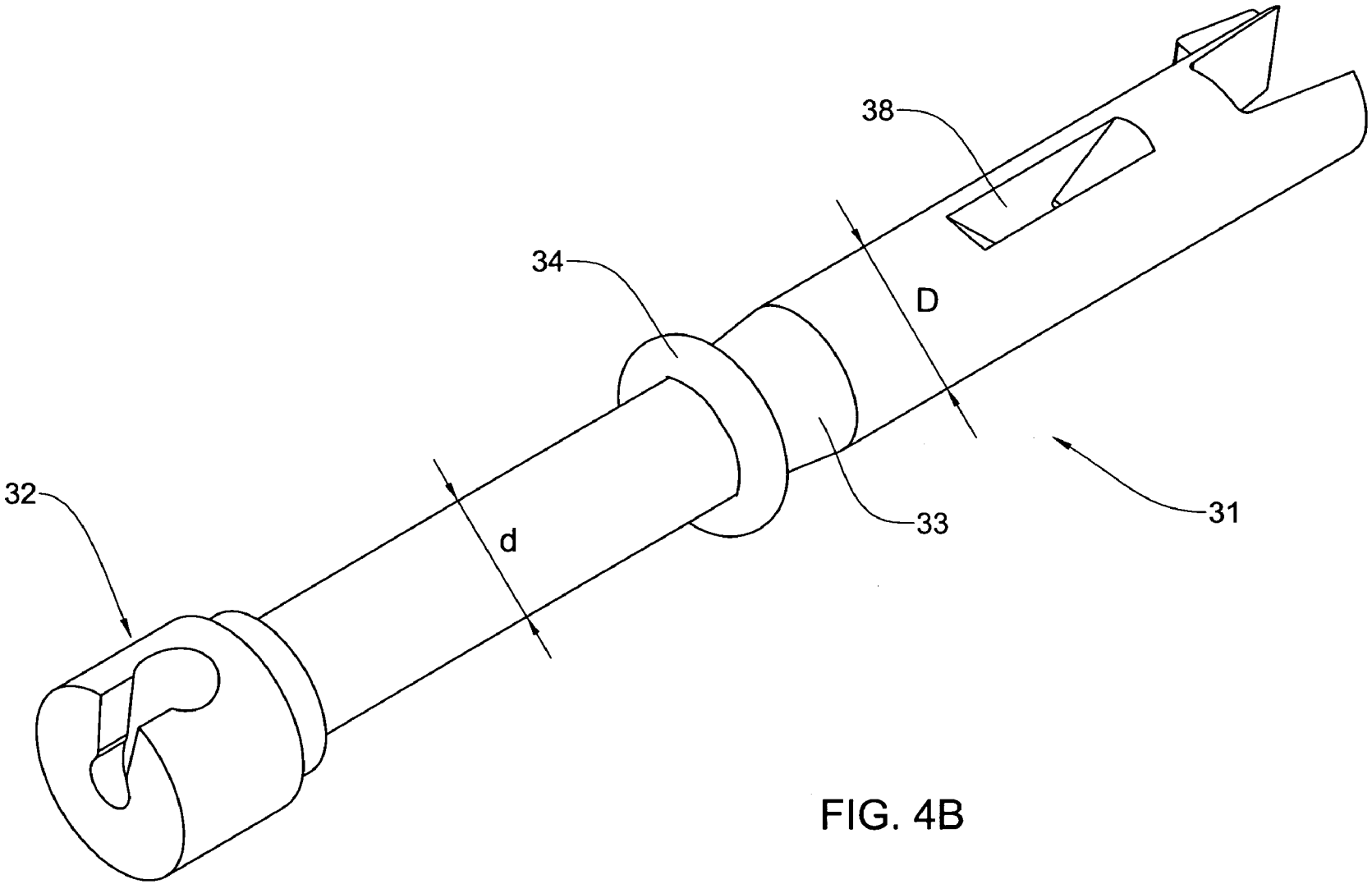
FIG. 4B is an isometric view of the lead bar and friction ring of the control mechanism.

When the actuator 20 is released by the user, the spring 37 decompresses (expands) and biases the lead bar 31 in an upwards direction (direction of arrow 107 in FIG. 3A). This upwards displacement causes the lead bar 31 to reposition itself with reference to the sleeves 35 and 36, such that the friction ring 34 is now again positioned on the large diameter 'D' of the tapering portion 33 and the control mechanism 1 returns to a "fixed mode" wherein any further displacement is temporarily arrested.

Referring now also to FIGS. 6A to 6D and FIGS. 7A to 7D, in order to lower the slats 102, namely switching to a "lowering mode", upward displacement of the actuator 20 is required. This upward displacement entails pivoting of the shift pin 26 about pivot point 38P (FIGS. 6B, 6C, 7B and 7C) from its normally upright position (FIGS. 3A, 3B, 6A and 7A) substantially perpendicular to the lead bar 31 and parallel to surfaces 26I and 38IV, gradually into a position where it rests in the inclined channel of the shaped cavity 38, such that the pin 26 extends substantially parallel to the inclined surfaces 38II and 38III.

Figure 6A:
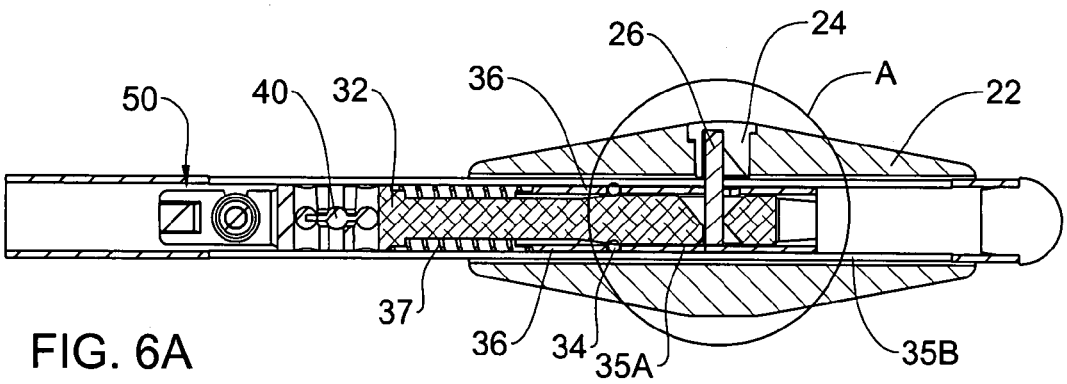
FIGS. 6A to 6D are cross section views of the control mechanism of FIG. 1 showing gradual angular displacement of the shift pin during lowering of the slats, with the actuator removed.
Figure 6B:
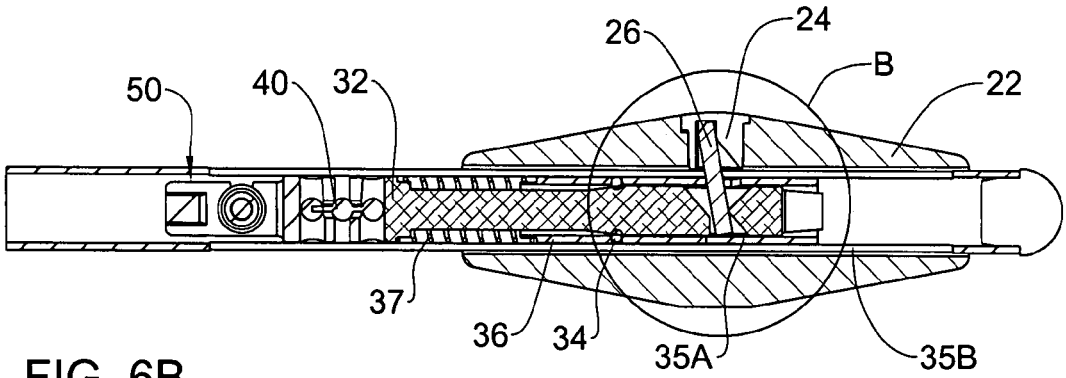
Figure 6C:
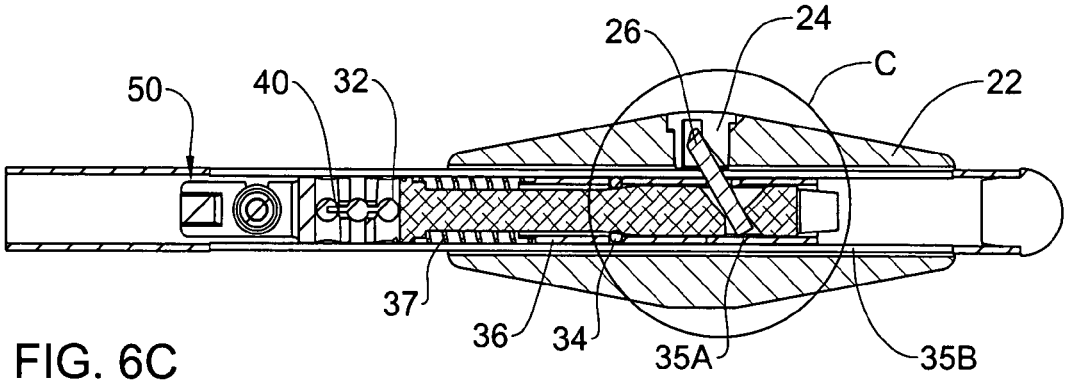
Figure 6D:
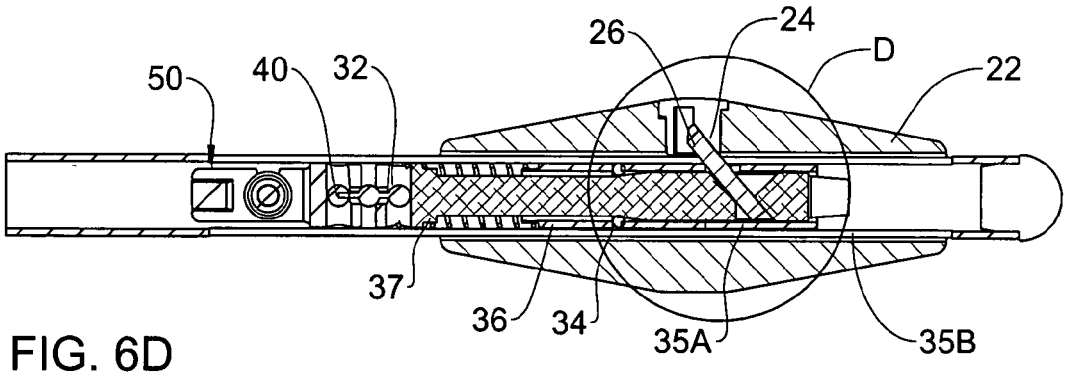
Figure 7A:
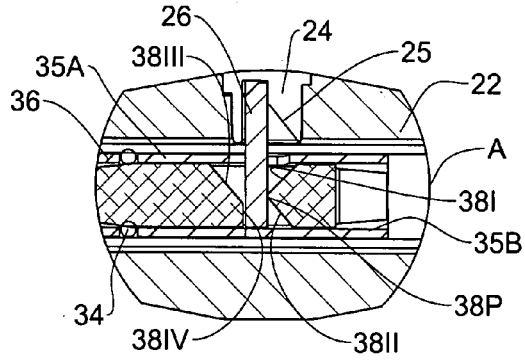
FIGS. 7A to 7D are enlargements of details A to D in FIGS. 6A to 6D, respectively, with the actuator removed.
Figure 7B:
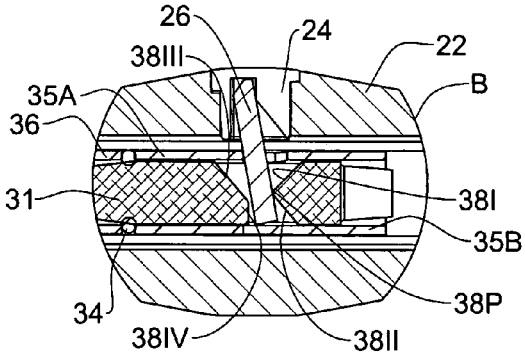
Figure 7C:
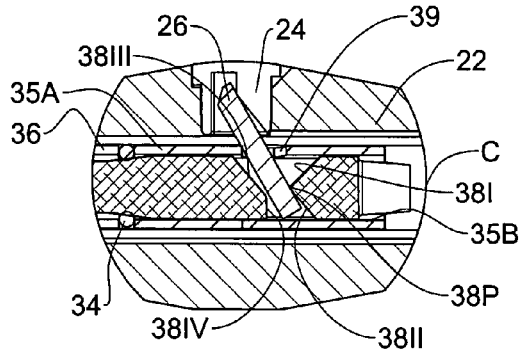
Figure 7D:
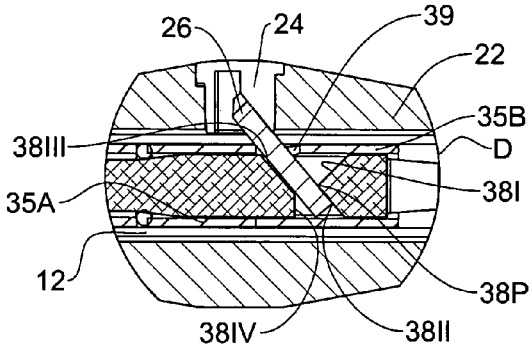

With the rod 10 being axially fixed to headrail 101, pivotal displacement of the shift pin 26 entails axial displacement of the first sleeve 35A and the second sleeve 36 in an upward direction, against the biasing effect of the spring 37. Following this displacement of the sleeves 35A and 36, the friction ring 34 displaces upwards as well, so that it becomes positioned on the small diameter 'd' of the tapering portion (FIGS. 6C and 7C). When positioned over the small diameter 'd', the friction ring 34 shrinks, acquiring a smaller diameter, whereby the friction between the friction ring 34 and the hollow rod 10 is reduced, allowing the inner mechanism 30 to freely slide up the rod 10 (FIGS. 6D and 7D). Sliding the actuator 20 up the rod 10 pulls on the lift cord 103, and thereby raises the blinds 102. In the particular example, since the cords 103 are looped about a roller 52 of the cord coupling unit 50, there is a pulley effect i.e. displacement of the lead rod 31 with the articulated cord coupling unit 50 at distance X entails raising/lowering of the slats at a distance corresponding with 2X.

When the actuator 20 is released, the spring 37 expands and thus causes the lead bar 31 to displace in an upwards direction. This upwards displacement causes the lead bar 31 to reposition itself with reference to the sleeves 35 and 36, such that the ring 34 is now again positioned over the large diameter 'D' of the conical surface 33 and the control mechanism 1 returns to its respective "fixed mode" such that when the user leaves the actuator body 22 the system is at an arrested position.

It should be noted, that raising/lowering ratio of the salts may be pre-determined to be in the range of about 1:1 to 1:3 due to a pulley mechanism (not shown) fitted with the combined mechanism 110 located in the headrail (FIG. 1), i.e. displacement of the actuator 20 at distance X along the rod 10 may entail a 2X or 3X raise/lowering of the blinds 102, depending on the transmission ratio of the pulley mechanism (i.e. using a different pulley arrangement other ratios may be achieved).

The first sleeve 35A and the back sleeve 35B may be integrated into one sleeve 35 formed with the aperture 39, adapted to receiver the shift pin 26. Alternatively, they may be separate elements.

The rod 10 is articulated to the combined mechanism 110, whereby revolving the hollow rod 10 about its longitudinal axis X-X either clock-wise or counter clock-wise entails corresponding tilt of the blinds 102 in one direction or the other, as known per se. However, such rotation of the hollow rod 10 does not twist the lift cord 103 around itself due to the connection of the inner mechanism 30 to the lift cord coupling unit 50 by the ball link 40.

It should also be noted, that according to other possible embodiments of the present invention, the raising/lowering and tilting operations performed by the control mechanism 1 may work individually, i.e. the control mechanism 1 may be used only for raising/lowering the blinds 102 whereas a separate tilting mechanism may be fitted to the blinds at another location along the headrail.

Those skilled in the art to which this invention pertains will readily appreciate that numerous changes, variations and modifications can be made without departing from the scope of the invention mutatis mutandis.

The invention claimed is:

1. A control mechanism for a Venetian blind comprising a plurality of slats suspended from a headrail by lift cords, said control mechanism comprising a hollow rod articulated to the headrail and accommodating said lift cords extending to a lead bar coaxially displaceable within the rod and an elevation assembly manipulable by an actuator slidingly received over the rod; and engaged with the lead bar such that upward displacing of the actuator entails lowering of the slats and downwards displacing of the actuator entails raising of the slats, said elevation assembly further comprising a friction mechanism for arresting the slats at any respective elevation, wherein the friction mechanism comprises a friction member axially displaceable over a tapering portion of the lead bar, between an unlocked position in which the friction member is shrunken and is free to slide within the rod, and a locked position in which the friction member is expanded and frictionally arrested within the rod.

2. A control mechanism according to claim 1, wherein the friction member is displaceable into the unlocked position by a sleeve coaxially extending between the lead bar and the rod, said sleeve being articulated to the actuator and is displaceable between a first position where the friction member is retained at its locked position, and a second position wherein the friction member is displaced into its unlocked position.

3. A control mechanism according to claim 2, wherein the sleeve is normally biased into the first position.

4. A control mechanism according to claim 3, wherein a the sleeve is biased into the first position by a biasing member having one end bearing against the sleeve and a second end bearing against an end portion of the lead bar.

5. A control mechanism according to claim 3, wherein the sleeve is biased into the first position by a force generated by the load of the slats pulling the lead bar so as to displace with respect to the sleeve.

6. A control mechanism according to claim 2, wherein friction member extends between a first sleeve segment and a second sleeve segment.

7. A control mechanism according to claim 6, wherein the second sleeve segment extends between the first sleeve segment and a third sleeve segment, said sleeve segments being compacted by a biasing member.

8. A control mechanism according to claim 2, wherein fit between the sleeve and an inside surface of the rod is tighter than fit between the sleeve and the lead bar, whereby the mechanism does not spontaneously displace under weight of the slats.

9. A control mechanism according to claim 1, wherein the friction member is an O-ring.

10. A control mechanism according to claim 1, wherein the actuator is formed with an ergonomically shaped body so as to be easily gripped.

11. A control mechanism according to claim 1, wherein the slats are supported by string ladders.

12. A control mechanism according to claim 2, wherein the actuator is articulated to the lead bar and to the sleeve by a shift pin having one end received within the actuator and a second end thereof received within a cavity formed in the lead bar; said shift pin extending through an aperture formed in the sleeve.

13. A control mechanism according to claim 12, wherein displacing the actuator in a first direction entails corresponding displacement of the sleeve and lead bar in said first direction, however with advanced displacement of the lead bar, and sliding displacing the actuator in a second direction entails corresponding displacement of the sleeve and lead bar in said second direction, however with advanced displacement of the lead bar.

14. A control mechanism according to claim 13, wherein while displacing the actuator in the first direction the shift pin is retains a substantially upright position, and while displacing the actuator in the second direction the shift pin pivots within the actuator and within the aperture formed in the sleeve.

15. A control mechanism according to claim 12, wherein the rod is formed with a longitudinal slot slidingly accommodating the shift pin.

16. A control mechanism according to claim 1, wherein the rod is articulated at a top end thereof with a tilt mechanism received within the headrail, whereby revolving the rod about its longitudinal axis either clock-wise or counter clock-wise entails corresponding tilt of the blinds in one direction or the other.

17. A Venetian blind comprising a plurality of slats suspended from a headrail by lift cords, said Venetian blind comprising a hollow rod articulated to the headrail and accommodating said lift cords extending to a lead bar coaxially displaceable within the rod, and an elevation assembly manipulable by an actuator slidingly received over the rod and engaged with the lead bar such that upward displacing of the actuator entails lowering of the slats and downwards displacing of the actuator entails raising of the slats, and a friction mechanism for arresting the lead bar within the rod at any respective location, said elevation mechanism further comprising a friction mechanism for arresting the lead bar within the rod at any respective location, wherein the friction mechanism comprises a friction member axially displaceable over a tapering portion of the lead bar, between an unlocked position in which the friction member is shrunken and is free to slide within the rod, and a locked position in which the friction member is expanded and frictionally arrested within the rod.

* * * * *